US005899628A

United States Patent [19]

Pei-Chi

[11] Patent Number: 5,899,628

[45] Date of Patent: May 4, 1999

[54] ROAD ANTI-DAZZLE DEVICE

[76] Inventor: Chang Pei-Chi, No. 112, Shu Kun Street, Shu Kun Tsun, Shu Kun Hsiang Taichung Hsien, Taiwan

[21] Appl. No.: 09/139,028

[22] Filed: Aug. 24, 1998

[51] Int. Cl.[6] ..... E01F 9/01

[52] U.S. Cl. ..... 404/9; 404/6

[58] Field of Search ..... 404/6, 9; 224/329

[56] References Cited

U.S. PATENT DOCUMENTS

| | | | |
|---|---|---|---|
| 3,591,144 | 7/1971 | Iving | 404/6 |
| 4,995,538 | 2/1991 | Marengo | 224/329 |
| 5,597,262 | 1/1997 | Beavers et al. | 404/6 |

FOREIGN PATENT DOCUMENTS

| | | | |
|---|---|---|---|
| 1503847 | 3/1978 | United Kingdom | 9/1 |

*Primary Examiner*—Thomas B. Will
*Assistant Examiner*—Raymond Addie
*Attorney, Agent, or Firm*—Bacon & Thomas

[57] ABSTRACT

A road anti-dazzle device that is installed on a safety island to prevent car lights from stimulating drivers' eyes so as to avoid possible road accidents. The device includes a cylinder made of high-density polyethylene materials. The cylinder has a plurality of longitudinal adjacent curved faces that have turbulent functions to enhance the cylinder's resistance to wind pressure. The cylinder has an elongated slot on a bottom portion thereof. A bolt is passed through a securing disk and into the bottom end of the cylinder. The bolt passes out from the elongated slot so that a circumferential flange of the securing disk presses against the bottom portion of the cylinder. A long-handle spanner is used to extend into a through hole at an upper end of the cylinder to lock the bolt into a threaded hole in the ground. The cylinder is firmly positioned on the ground by the securing disk. When installed on a safety island, the cylinder is a circumferential circle that has the same sectional area when viewed from any angle thus providing the largest anti-dazzle area. Furthermore, as the cylinder is made of high-density polyethylene, it can return original shape after deformation when hit and will not easily break to cause secondary harm.

1 Claim, 2 Drawing Sheets

ROAD ANTI-DAZZLE DEVICE

BACKGROUND OF THE INVENTION (a) Field of the Invention

The present invention relates to a road anti-dazzle device, and more particularly to an anti-dazzle device that includes a cylinder made of high-density polyethylene. The cylinder has a plurality of longitudinal adjacent curved faces that have turbulent functions to enhance the cylinder's resistance to wind pressure. The sectional area of the cylinder appears to be the same when viewed from any angle, thereby providing the largest anti-dazzle area to enhance anti-dazzle effects. A plurality of cylinders can be spaced apart on a safety island. A securing disk is used to press the bottom portion of the cylinder to the ground. A bolt is used to firmly position the cylinder on the ground. When the cylinder is hit, it can automatically restore its original shape and will not break to cause secondary harm.

(b) Description of the Prior Art

Conventional anti-dazzle plates are made of glass fiber or hard plastics (PE). Once they are hit, they will break into pieces, which may cause another road accident. Anti-dazzle plates are installed on safety islands. As their side views reduce their sectional areas, the anti-dazzle effect is affected.

SUMMARY OF THE INVENTION

A primary object of the present invention is to provide a road anti-dazzle device. The device comprises a cylinder made of high-density polyethylene materials. The outer surrounding wall of the cylinder has a plurality of longitudinal adjacent curved faces that have turbulent functions to enhance the cylinder's resistance to wind pressure. The cylinder is a circumferential circle that appears to have the same sectional area when viewed from any angle so as to provide the largest anti-dazzle area to enhance anti-dazzle effects. As the cylinder is made of high-density polyethylene, it can return to its original shape after deformation when hit and will not break to cause secondary harm.

Another object of the present invention is to provide a road anti-dazzle device, in which the cylinder has a bottom portion provided with an elongated slot. A bolt is used to pass through a securing disk into the bottom end of the cylinder. The bolt is passed out through the elongated slot. The securing disk has a circumferential flange that press against the bottom portion of the cylinder. A long-handle spanner is used to extend into a through hole at an upper end of the cylinder to lock the bolt into a threaded hole in the ground so that the cylinder can be firmly secured on the ground by means of the securing disk and the bolt. The cylinder can firmly stand on the ground even when hit and can resist strong winds.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
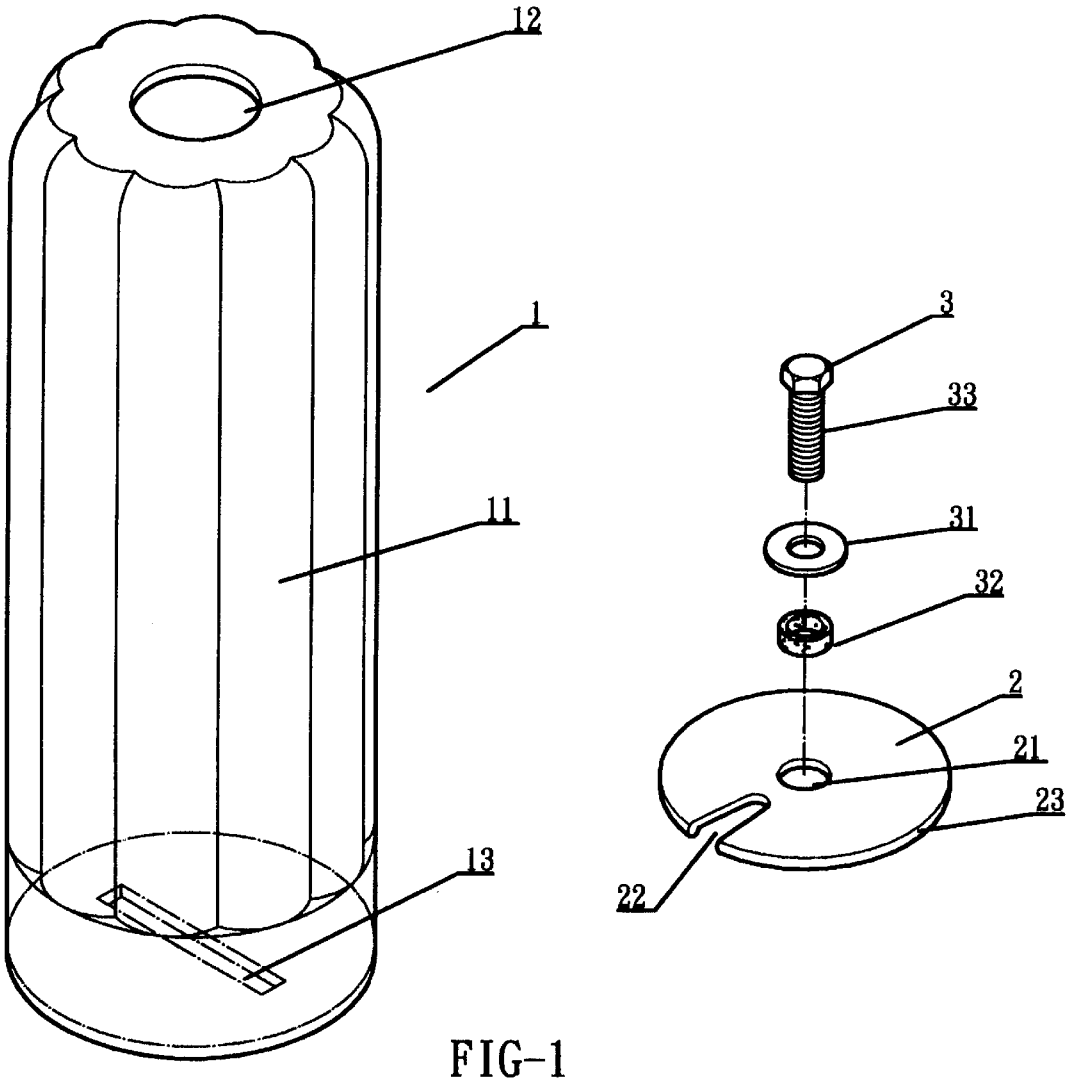
FIG. 1 is a perspective exploded view of the present invention.

With reference to FIG. 1, high-density polyethylene is used as raw material to form a cylinder 1. A plurality of adjacent curved faces 11 are longitudinally provided on the outer wall of the cylinder 1. The curved faces 11 are capable of turbulent actions to enhance the strength of the cylinder 1 against wind pressure. The cylinder 1 is a circumscribed circle whose sectional area remains unchanged when viewed from any angle so as to provide a largest anti-dazzle area to enhance its effects. In addition as the cylinder 1 is made of high-density polyethylene when it is hit and deforms in shape, it can automatically return to its original shape and will not break in pieces to cause secondary harm.

Figure 3:
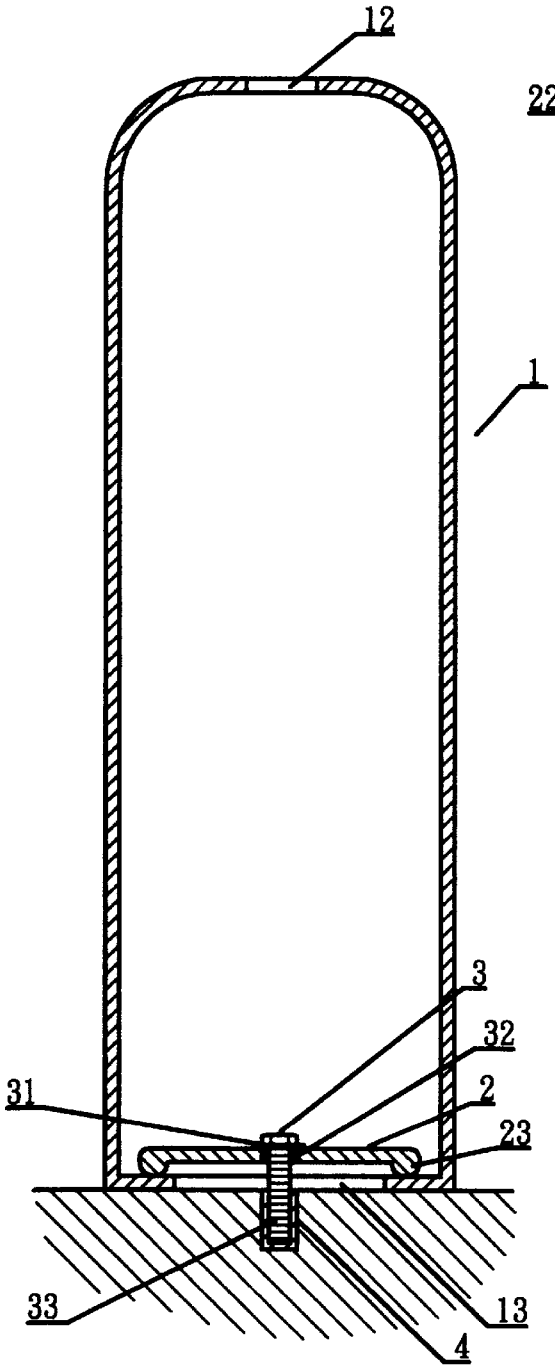
FIG. 3 is a sectional assembled view of the present invention.
Figure 2:
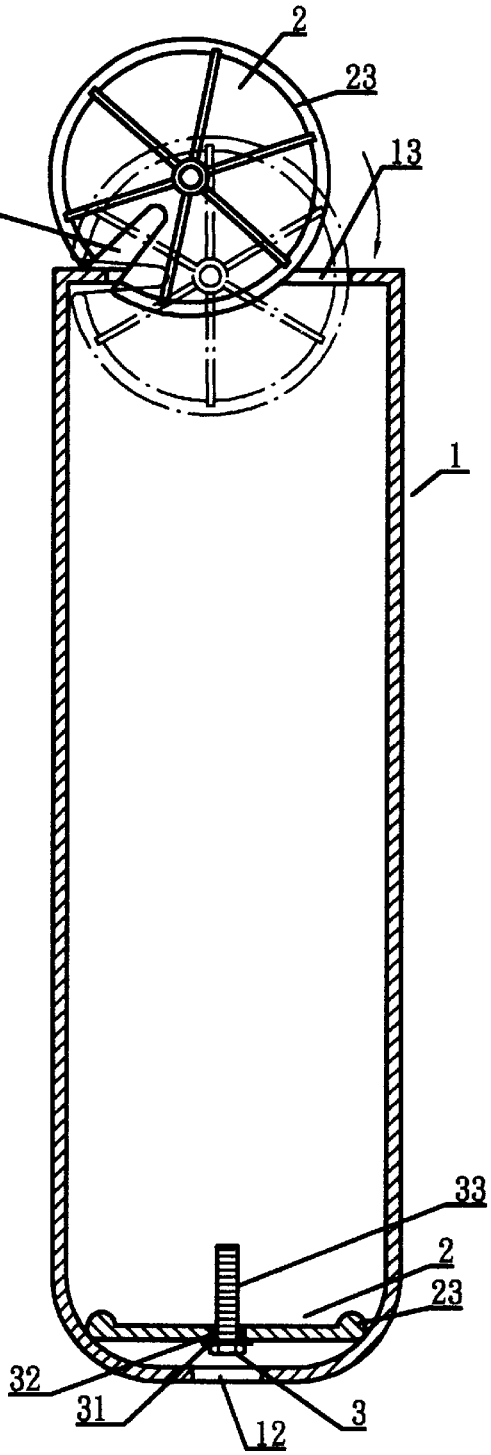
FIG. 2 is a schematic view illustrating insertion of a securing disk into a cylinder of the present invention.

Referring to FIGS. 1 and 2, the cylinder 1 is provided with a through hole at an upper end, and an elongated slot 13 at a bottom portion. A securing disk 2 is centrally provided with a through hole 21; a notch 22 orienting towards the through hole 21 is provided on the securing disk 2. A bolt 3 is passed through a washer 31 and a rubber sleeve 32. When the bolt 3 is passed through the through hole 21 of the securing disk, the rubber sleeve 32 will just fit into the through hole 21 of the securing disk 2 to press against the bolt 3 slightly, so that the bolt 3 will easily not slip out of the through hole 21 of the securing disk 2. Referring to FIG. 2 when securing the cylinder 1, the strength should be kept at an optimum state. This is achieved by shortening the elongated slot 13 to the smallest degree in which the securing disk 2 can just vertically insert thereinto. First of all, the cylinder 1 is erected upside down. Then, by inserting that end of the securing disk 2 with the notch 22 into one end of the elongated slot 13, the entire securing disk 2 can be entirely inserted into the cylinder 1. The bolt 3 is next passed through the through hole 21 of the securing disk 2 such that threads 33 of the bolt 3 sink into the cylinder 1, while the rubber sleeve 32 presses the bolt 3 slightly against the through hole 21 of the securing disk 2. And by deliberately disposing the opposite side of the securing disk 2 into the cylinder 1, the bolt 3 will not slip out. When the cylinder 1 is turned upside down to return to its proper position, the securing disk 2 will naturally drop to the bottom portion of the cylinder 1. Then the threads 33 of the bolt 3 will just pas through the elongated slot 13. Referring to FIG. 3, the bottom portion of the cylinder 1 is pressed by a flange at the circumference of the securing disk 2. As regards how the bolt 3 is driven into a threaded hole 4 in the ground, a long-handle spanner is extended into the through hole 12 at the top end of the cylinder 1 to drive the bolt 3 into the threaded hole 4 so that the securing disk 2 presses the bottom portion of the cylinder 1 tightly to the ground surface to firmly position the cylinder 1 on the ground.

In summary, the present invention utilizes high-density polyethylene material to form the cylinder, which is therefore capable of returning to its original shape after deformation due to impact. It can withstand impacts and will not break easily. The curved faces on its outer wall have turbulent functions to resists wind pressure. The special installation of the securing disk in the cylinder enables the cylinder to be positioned on the ground in a stable manner. Furthermore due to the circular shape of the cylinder, the sectional area of the cylinder when viewed from any angle is the same, so that the largest anti-dazzle area can be achieved.

Although the present invention has been illustrated and described with reference to the preferred embodiment thereof, it should be understood that it is in no way limited to the details of such embodiment but is capable of numerous modifications within the scope of the appended claims.

What is claimed is:

1. A road anti-dazzle device that is installed on a safety island to prevent car lights from stimulating drivers' eyes so as to avoid possible road accidents, said device comprising:

a cylinder made of high-density polyethylene materials so that it can return to its original shape after deformation and will not break to cause secondary harm, said cylinder being provided with a plurality of longitudinally oriented adjacent curved faces on its outer surrounding wall, said curved faces having turbulent functions to enhance said cylinder's resistance to wind pressure, said cylinder having a top end provided with a through hole, and a bottom portion formed with an elongated slot;

a securing disk being centrally provided with a through hole, and a notch orienting towards said through hole, said securing disk further having a circumferential flange on a bottom face thereof; and a bolt passing through a washer and a rubber sleeve and further through said through hole of said securing disk, said rubber sleeve just fitting in said through hole of said securing disk to press slightly against said bolt so that said bolt will not easily slip out of said through hole of said securing disk, whereby said cylinder is erected upside, and said securing disk is inserted into one end of said elongated slot of said cylinder using said notch thereof so that said securing disk can be inserted into said cylinder entirely, said bolt passing through said through hole of said securing disk with threads thereof sinking into said cylinder while said rubber sleeve pressing said bolt slightly against said through hole of said securing disk, said securing disk being deliberately dropped into said cylinder with its reverse side so that said bolt will not slip out, said cylinder being erected in its proper position subsequently so that said securing disk naturally drops to the bottom portion of said cylinder while said threads of said bolt passing through said elongated slot of said cylinder, the bottom portion of said cylinder being pressed by said circumferential flange of said securing disk, said bolt being locked into a threaded hole in the ground using a long-handle spanner that is extended into said through hole at the top end of said cylinder to drive said bolt into said threaded hole, so that said securing disk presses the bottom portion of said cylinder firmly to the ground.

* * * * *